US007249547B2

(12) United States Patent
Mori et al.

(10) Patent No.: US 7,249,547 B2
(45) Date of Patent: Jul. 31, 2007

(54) PAPER CUTTER

(75) Inventors: Makoto Mori, Tokyo (JP); Fumio Shimizu, Tokyo (JP)

(73) Assignee: Carl Manufacturing Co., Ltd., Tokyo (JP)

( * ) Notice: Subject to any disclaimer, the term of this patent is extended or adjusted under 35 U.S.C. 154(b) by 242 days.

(21) Appl. No.: 10/919,889

(22) Filed: Aug. 16, 2004

(65) Prior Publication Data

US 2005/0039589 A1 Feb. 24, 2005

(30) Foreign Application Priority Data

Aug. 20, 2003 (JP) ..... 2003-296728

(51) Int. Cl.
*B26D 7/00* (2006.01)

(52) U.S. Cl. ..... 83/455; 83/485; 83/614

(58) Field of Classification Search ..... 83/627, 83/564, 452–456, 468.5, 468.6, 468.7, 483–486, 83/613–616
See application file for complete search history.

(56) References Cited

U.S. PATENT DOCUMENTS 3,973,459 A * 8/1976 Stowe ..... 83/455
5,287,783 A * 2/1994 Mori ..... 83/455
5,524,515 A * 6/1996 Boda ..... 83/455
6,079,307 A * 6/2000 Mori ..... 83/564
7,011,008 B2 * 3/2006 McLean et al. ..... 83/605
2003/0010176 A1 * 1/2003 Chiang ..... 83/618

FOREIGN PATENT DOCUMENTS

EP 0691189 A1 1/1996
JP 3113953 9/2000

* cited by examiner

*Primary Examiner*—Kenneth E. Peterson
*Assistant Examiner*—Phong Nguyen
(74) *Attorney, Agent, or Firm*—Everest Intellectual Property Law Group; Michael S. Leonard

(57) ABSTRACT

A paper cutter comprising a pair of four-joint link array mechanisms disposed in parallel between a paper holding member and a base, wherein pivotal links adjacent between the respective four-joint link array mechanisms are disposed to intersect with each other and to be slanted in directions opposite each other; in association with pivotal movements of the pivotal links, connecting links move in opposition to each other in a longitudinal direction; a downward operation force of the paper holding member acts as a pulling force on the respective connecting links; vertical movement of the paper holding member is constantly maintained in a parallel state with respect to the base; and a substantially uniform pressing force is imparted in a longitudinal direction of the paper holding member in cooperation with the vertical movement of the paper holding member.

4 Claims, 9 Drawing Sheets

PAPER CUTTER

BACKGROUND OF THE INVENTION

1. Field of the Invention

The invention relates to a paper cutter for cutting to-be-cut paper placed in a correct position on a base, and more specifically, the invention relates to a paper cutter capable of securely and steadily press-holding to-be-cut paper onto a base.

2. Description of the Related Art

In a conventionally used paper cutter, a paper holding member supported on a base to be vertically movable is provided. To-be-cut paper positioned and placed on the base is press-held by the paper holding member, a slider is moved along the paper holding member, and the to-be-cut paper is cut by a rotary blade attached to the slider.

As a paper holder unit in a paper cutter of the type described above, for example, there is a paper holder unit in accordance with Japanese Patent No. 3113953 owned by the present applicant. The paper holder unit in the paper cutter according to the above-referenced patent is constructed as described hereunder. There are disposed two operation rods, namely first and second operation rods, which are formed of flat parallelogram plate materials each having slanted faces being parallel with each other at both side end portions in a longitudinal direction of the base. The two operation rods, namely the first and second operation rods, are arranged in parallel with each other on the base and are supported thereon to be horizontally movable. These operation rods are disposed such that the slanted faces in corresponding end portions of the respective adjacent operation rods are disposed in vertically opposite slanted directions. In addition, first and second movable members are disposed in opposition to the vertically opposite slanted faces.

The first and second movable members are movably supported in a vertical direction at both side end portions of the longitudinal direction of the base. A paper holding member is bridged between the first and second movable members, whereby both side end portions of the paper holding member in a longitudinal direction are supported. The first and second movable members are constantly urged upward by elastic forces of coiled springs, and are disposed to a predetermined height. A space in which the to-be-cut paper is to be inserted is formed between the paper holding member and the base. In the paper holding member, a slider to which a rotary blade is attached is slidably provided, and is positioned to the cutting position of the to-be-cut paper in accordance with an edge of the paper holding member. A side face of the rotary blade of the slider rotates in contact with the edge of the paper holding member whereby to cut the to-be-cut paper.

In the first movable member, there are provided adjacent to each other an abutment portion (corner portion) for abutting on the upward slanted face formed in the first operation rod, and an abutment portion (bottom edge of a horizontally recessed opening) for abutting on the downward slanted face formed in the second operation rod. In the second movable member, in the disposition relationship opposite to the above, there are adjacently provided an abutment portion (bottom edge of a horizontally recessed opening) for abutting on the downward slanted face formed in the first operation rod, and an abutment portion (corner portion) for abutting on the upward slanted face formed in the second operation rod.

In the conventional paper holder unit, in the event that the slider including the rotary blade is operated to slide while the paper holding member is depressed, when the paper holding member is depressed by the slider in resistance with the elastic force of the first movable member, the abutment portion (corner portion) of the first movable member depresses the upward slanted face of the first operation rod. At this event, according to wedge actions by the upward slanted face of the first operation rod and the abutment portion (corner portion) of the first movable member, the first operation rod performs a horizontal movement along the base. By the horizontal movement of the first operation rod, a tip of the downward slanted face formed at the other end of the first operation rod is pushed into the abutment portion (bottom edge of the horizontally recessed opening) of the second movable member. Then, the second movable member is pulled down according to wedge actions by the downward slanted face formed at the other end portion of the first operation rod and the abutment portion (bottom edge of the horizontally recessed opening) of the second movable member.

When the second movable member is pulled down, the abutment portion (corner portion) of the second movable member formed adjacent to the abutment portion (bottom edge of the horizontally recessed opening) of the second movable member abuts on the upward slanted face of the second operation rod, whereby the second operation rod performs a horizontal movement in a direction opposite to the first operation rod. When the second movable member moves in the horizontal direction, a tip of the downward slanted face formed at the other end of the second operation rod is pushed into the abutment portion (bottom edge of the horizontally recessed opening) of the first movable member. Then, the first movable member is pulled down according to wedge actions by the downward slanted face of the second operation rod and the abutment portion (bottom edge of the horizontally recessed opening) of the first movable member.

As described above, the slanted faces formed in the both end portions of the first and second operation rods in the longitudinal direction are disposed parallel with each other with respect to the same operation rods, and the slanted faces of the adjacent operation rods are slanted in opposite directions alternately. As such, when the first and second operation rods and the first and second movable members move in cooperation with one another, the first movable member on the one side is vertically moved, whereby also the second movable member on the other side is enabled to vertically move in the same direction as the first movable member.

Thereby, when the paper holding member is depressed by the slider at an arbitrary position of a rail, the first and second movable members are moved downward, whereby the paper holding member is moved downward while the parallel state with respect to the base is being constantly maintained. When the depressing force of the paper holding member imparted by the slider is relieved, the paper holding member is ascended so as to be detached from the base by the forces of the coiled springs disposed between the first and second movable members and the base.

Accordingly, even when cutting a stack of many to-be-cut paper sheets, misalignment of the to-be-cut paper is prevented and concurrently, alignment of the cutting position can easily be performed, consequently enabling cutting to be performed into accurate sizes.

As described above, according to the conventionally used paper holder unit as disclosed in the specification of the above-referenced patent, the paper holding member is depressed by the slider and is concurrently caused to slide. Thereby, at each slide position of the slider, the first and second operation rods can be moved in parallel in a reversed direction, respectively, via the paper holding member, and the first and second movable members can be descended in cooperation with the horizontal movement of the first and second operation rods. According to the descendent movement of the first and second movable members, the paper holding member supported between the first and second movable members can be moved downward while the parallel state is being maintained, consequently enabling the paper holding member to press-hold the to-be-cut paper substantially at a uniform state.

However, the force to descend the first movable member when cutting by the slider is initiated causes the first operation rod to perform the horizontal movement. Concurrently, the force works to descend the second movable member, and then works as a force causing the second operation rod to perform the horizontal movement. As such, a problem arises that an excessive force should be performed before the horizontal movement of the second operation rod.

Further, in terms of the structures, the first and second operation rods slide in a surface-contact state where the operation rods are in close contact with the abutment surfaces of the first and second movable members. As such, the sliding resistance due to the surface contact is increased, and nonuniformity in the operation forces to the first and second operation rods is facilitated to occur, thereby making it difficult to secure smooth sliding of the first and second operation rods. Particularly, with first and second operation rods formed of a material having flexibility, distortion in a horizontal direction is caused in the first and second operation rods during operation, thereby offering the problem of disabling obtaining high sliding performance with respect to the base.

In addition, the angles at which the abutment surfaces of the first and second movable members and the slanted faces of the first and second operation rods engage with one another should be appropriately set. Therefore, the shapes, structures, patterns, and the like of the first and second movable members, first and second operation rods, and the like should be strictly set, and high dimensional precisions for products become necessary. Further problems take place in that highly-level tuning should be performed for setting/alignment and the like between the individual members such as the first and second movable members and the first and second operation rods, and strict inspection should be carried out to solve such the problems. Consequently, increases in costs, such as facility costs and manufacturing costs are introduced, and strict quality control is required.

When sufficient precisions cannot be obtained in regard to set dimensions, assembly tuning, and the like, the frictional resistance on the slanted faces are increased, also the nonuniformity in the slide resistances of the first and second operation rods is increased. Thus, a force applied to the paper holding member from the slider are disabled to work as a force for intensively depressing both the first and second movable members. Consequently, it becomes to difficult to descend both the first and second movable members at the same time, whereby the paper holding member cannot be uniformly press-held with respect to the to-be-cut paper, and an incident occurs in which the paper holding member partly floats above the base.

In the meantime, it can be contemplated that in order to steadily press-hold the to-be-cut paper placed on the base, a robust paper holding member is used, and the rigidities of the first and second operation rods are enhanced to secure higher durabilities thereof. However, when the construction of this type is employed, while the rigidities, durabilities, and the like of the first and second operation rods can be secured, special materials should be used to form the first and second operation rods. Consequently, material costs are increased, thereby introducing the problem of impairing low-cost production.

The present invention is made to solve the above-described problems. Accordingly, an object of the invention is to provide a paper cutter including a paper-holding function, in which the structure is simple and inexpensive, a paper-holding function maintaining an ensuredly steady and excellent state is secured, quality improvement and cost reduction can be implemented, and a press-holding force for paper onto a base is substantially uniformed and can be intensified even when an arbitrary position of a paper holding member is depressed by a slider.

SUMMARY OF THE INVENTION

A basic construction of the present invention is a paper cutter wherein to-be-cut paper placed on a base is press-held by a straight-rod-like paper holding member supported on the base and movable vertically, and a cutting blade cuts the to-be-cut paper while moving along the paper holding member, characterized in that the paper cutter comprises a four-joint link array mechanism which is disposed between the base and the paper holding member and which vertically moves in cooperation with a vertical movement of the paper holding member to generate a substantially uniform pressing force in a longitudinal direction of the paper holding member, and that the four-joint link array mechanism is disposed such that a downward operation force of the paper holding member impart a pulling force to a connecting link of the four-joint link array mechanism.

In the above construction, the four-joint link array mechanism preferably comprises first and second pivotal links supported on the base so as to be pivotable in a plane parallel with the paper holding member; and the connecting links that are supported by free ends of the respective first and second pivotal links to be relatively rotationally movable and that extend along a face on a side opposite a pressing face of the paper holding member.

Further, the four-joint link array mechanism preferably comprises first and second four-joint link array mechanisms disposed in parallel along the paper holding member, wherein the first and second pivotal links adjacent between the individual four-joint link array mechanisms are disposed to intersect with each other and to be slanted in directions opposite each other; and in association with pivotal movements of the first and second pivotal links disposed to intersect with each other, the individual four-joint link array mechanisms move the individual connecting links in opposition to each other in the longitudinal direction. In this case, the first pivotal link is preferably set slightly shorter than the second pivotal link.

The connecting link is preferably formed of a plate material or a wire rod type material. In addition, it is preferable that the paper holding member comprises a paper holding plate disposed with a necessary space with respect to the base; and a link guide space provided between the paper holding member and the paper holding plate to guide the longitudinal movement of the connecting link. In this case, it is desirable that the link guide space is formed of the paper holding member and a link guide member that abuts on portions of the paper holding member; and both ends of the paper holding member and the link guide member in the longitudinal direction are disposed at both side end portions of the base in the longitudinal direction of the base and are supported by a pair of vertically movable support members;

and the paper cutter preferably further comprises a first abutment projection portion that abuts on a portion of the link guide member, at least on an undersurface of a end portion of the connecting link paper-cutting start side. In addition, the paper cutter preferably further comprises a second abutment projection portion that abuts on a portion of an upper surface of the connecting link, on an end-portion undersurface of the connecting link of the paper holding member on an opposite side of the first abutment projection portion.

It is preferable that a first resilient member is interposed between the support member and the base; and the support member and the link guide member comprise guide openings for inductively guiding pivotal movements of the first and second pivotal links, and the link guide member comprises a guide plate for inductively guiding the movement of the connecting link in the longitudinal direction.

Further, the paper holding plate may be supported on an undersurface of the link guide member to be vertically movable, and a second resilient member may be interposed between the paper holding plate and the link guide member. Alternately, the paper holding plate and the link guide member may be formed into an integral unit.

The cutting blade is supported by a moving unit that moves along the paper holding member; and the paper holding member comprises a guide face that performs slide-guiding of the moving unit.

It is a characteristic feature that the paper cutter of the present invention has the paper holding member that constantly maintains the parallel state with respect to the base and vertically moves, and the four-joint link array mechanisms capable of constantly generating substantially a uniform pressing force to the to-be-cut paper in the full length of the paper holding member in the longitudinal direction between the paper holding member and the base, so as to use a pulling force in which the operation force for depressing the paper holding member acts on connecting links in the four-joint link array mechanisms.

As described above, according to the prior art, when one end portion of the paper holding member on the cutting start position side is depressed by the slider, the first operation member moves downward whereby to cause the first operation rod to perform the parallel movement toward the final cutting position side of the paper holding member. According to the parallel movement of the first operation rod, the second operation member is descended whereby to cause the second operation rod to perform parallel movements toward the cutting start position side, which is a side opposite to the first operation rod. Accordingly, the frictional resistances between the slanted faces formed on the first and second operation rods and the first and second operation members are increased, so that the nonuniformity occurs also in the sliding forces of the first and second operation rods. Further, when deflection deformations occur in the respective operation rods, it becomes difficult to obtain smooth sliding of the first and second operation rods, whereby it becomes difficult for a force applied to the paper holding member from the slider to directly act as an equal intensive depression force on the first and second movable members.

On the contrary, with the four-joint link array mechanisms according to the invention being employed, the movement in the vertical direction of the paper holding member can be constantly performed in the parallel state with respect to the base. In addition, the downward operation force of the paper holding member can be used to act as a pulling force in the longitudinal direction of the paper holding member. Therefore, with a force to pull the connecting link in the longitudinal direction of the paper holding member for its downward rotational movement, the force can be used to act as substantially a uniform intensive force over the full length in the longitudinal direction of the paper holding member. Consequently, the to-be-cut paper can securely be press-held by the paper holding member in a steady state. As to the number of to-be-cut paper sheets, while it is regarding a large number of stacked to-be-cut paper sheets, even one to-be-cut paper sheet can be press-held in a substantially uniform state between the paper holding member and the base.

According to the paper cutter of the present invention, it is secured that the paper holding member vertically moves while constantly maintaining the parallel state with respect to the base. As such, even when an arbitrary position of the paper holding member is pressed by a human hand or finger, the paper holding member can be operated to securely provide a substantially uniform pressing force acting on to-be-cut paper over the full length in the longitudinal direction. Accordingly, it is possible to prevent the pressure force of the paper holding member from acting on the base disproportionately and to prevent the to-be-cut paper from displacing from the cutting position, so that paper cutting can be performed into accurate sizes when the number of to-be-cut paper sheets is one or more.

The four-joint link array mechanisms of the present invention may be constructed such that first and second pivotal links are used, in which two points are supported on the base as static kinematic pair and other two points are supported as dynamic kinematic pair, and connecting link for interconnecting the dynamic kinematic pair is disposed to vertically move along a face opposite to a pressing face of the paper holding member.

Preferably, the second pivotal link on the cutting start position side in the paper holder unit is disposed so as to be slanted upward to oppose the final cutting position of the paper holding member, and the first pivotal link on the final cutting position side is disposed so as to be slanted upward in the same direction as the second pivotal link.

When one end portion on the cutting start position side in the paper holding member is depressed by a moving unit (hereinafter also referred to as a "slider"), the second pivotal link rotationally moves. In association with the rotational movement of the second pivotal link, the first pivotal link receives the pulling force of the connecting link and rotationally moves in the same direction as the second pivotal link. At this event, the connecting link connecting the first and second pivotal links rotationally moves downward while maintaining the parallel state. With the downward rotational movement while the parallel state is being maintained, the other end portion on the final cutting position side of the paper holding member can be depressed through the connecting link. Thus, even in the other end portion on the final cutting position side of the paper holding member, press-holding can be performed at a pressing force sufficient to press-hold to-be-cut paper.

Thereby, even when the one end portion of the paper holding member is depressed by the slider, the operation can securely prevent the other end portion side of the paper holding member from such an instance causing the other end portion of the paper holding member to float. Further, the to-be-cut paper can be securely press-held at a sufficient pressure force also in the other end portion. Thus, although the structure of the four-joint link array mechanism is simple, quality improvement of the paper cutter and cost reduction can be implemented.

In the present invention, the construction preferably has two sets of four-joint link array mechanisms, namely, first and second four-joint link array mechanisms disposed in parallel with each other along the paper holding member. In this case, the first and second pivotal links adjacent between the four-joint link array mechanisms of the individual sets are disposed in tilt directions set in opposition to intersect with each other, and the respective connecting links of the four-joint link array mechanisms of the individual sets move in the longitudinal direction opposed each other.

When an arbitrary position of the paper holding member is depressed by the slider, both four-joint link array mechanisms of the individual sets are operated from the upper side by the paper holding member. Upon operation of the four-joint link array mechanisms of the individual sets, the respective connecting links of the four-joint link array mechanisms move in opposite directions and concurrently press along the longitudinal direction a face being in abutment with the connecting link on the side opposite to the pressing face of the paper holding member. Accordingly, even when an arbitrary position of the paper holding member is depressed by the slider, the paper holding member is capable of moving downward while constantly maintaining the parallel state with respect to the base. Consequently, the to-be-cut paper placed on the base can be press-held substantially uniformly along the longitudinal direction of the urging member.

With the depression force acting on the paper holding member at this event, any one of the first and second pivotal links plays the role of a base point, and the other performs driven rotationally movements. A pulling-force acting state is maintained with the connecting link, and the connecting link is enabled to remain the parallel state and to perform the pivotal rotation. Accordingly, regardless of the acting position of the depression force to the paper holding member in association with the slider operation, the paper holding member can be uniformly depressed at all times according to the respective connecting links in the four-joint link array mechanisms of the two sets.

When the slider exceeds an intermediate point between the cutting start position and the final cutting position in the paper holding member, the second pivotal link of the other set plays the role of the base point, and the first pivotal link of the four-joint link array mechanism of the same set receives the pulling force and performs driven movements. At this event, with the pivotal rotation maintaining the parallel state of the connecting links, the paper holding member can be descended to the base side over the full length in the longitudinal direction of the paper holding member while the parallel state is being maintained. Consequently, the pressing face of the paper holding member can be intensively press-held to the base in a constantly steady state.

For the structure of the four-joint link array mechanism, the link length of the first pivotal link on the final cutting position side can be set slightly shorter than that of the second pivotal link on the cutting start position side. According to this configuration, the first pivotal link slightly shorter in the link length than the second pivotal link rotationally moves at a smaller pivotal movement radius than the pivotal movement radius of the longer second pivotal link.

When both the first and second pivotal links are depressed from the upper side by the paper holding member, because of a pivotal movement difference (rotational movement difference) between the shorter first pivotal link and the longer second pivotal link, the longer second pivotal link intensively pulls the shorter first pivotal link via the connecting link, and concurrently, rotationally moves downward. Consequently, the depression force through the longer second pivotal link intensively acts as a pulling force on the connecting link in the longitudinal direction, and the paper holding member can be intensively depressed through the connecting link. By employing the four-joint link array mechanisms having the above construction, although the structure is simple, the press-holding force for the paper holding member can be significantly increased through the pivotal links.

As described above, according to the present invention, at the event of pivotal movements of the first and second pivotal links, the pulling force can be caused to act on the connecting links, and the connecting links can be driven to perform the descendent rotationally movement. Thus, a substantially uniform pressing force in the longitudinal direction of the paper holding member can be obtained through the connecting links. Consequently, without being influenced by distortion and the like of the connecting links, an intensive press-holding force can be secured between the paper-placing face of the base and the paper holding member. Further, these results can be obtained without requiring strict setting of the correlative positional relations between the paper holding member and the four-joint link array mechanisms.

The connecting link may have any structure as long as it enables the dynamic kinematic pair of the first and second pivotal links to be interconnected, and the size, pattern, structure, material, and the like thereof are not specifically limited. For example, the connecting link may be formed by using any of various inexpensive materials, such as plate materials made of flexible resin materials and metal materials, and wire rod type materials made of, for example, a rope and wire. Thus, the structure is simplified, and expensive materials having specific quality need not be used, whereby the economical effect is enhanced.

The pressing face of the paper holding member has a paper holding plate disposed with a necessary space with respect to the base. A link guide space sufficient to guide the movement of the connecting link in the longitudinal direction is secured on the reverse side of the pressing face. Consequently, the four-joint link array mechanism is not exposed to the outside, so that appearance design characteristics are excellent. This enables the paper cutter having a high commercial value to be obtained.

For a structure for moving the paper holding member in a vertical direction, such a construction may be employed in which both the paper holding member and the link guide member are provided and supported in such a form of a bridge ("bridge-support state") between the pair of support members. When the paper holding member and the link guide member are in the bridge-support state, the space formed in the paper holding member, which is formed on the reverse side of the pressing face, may be used as the link guide space. Thereby, the space between the paper holding member and the link guide member can be efficiently used.

With the above-described space, the pivotal movement positions of the four-joint link array mechanisms can be steadily and securely maintained, and a simple structure for guiding the pivotal movement of the four-joint link array mechanisms can be obtained. Further, when disposing the four-joint link array mechanisms in the paper holding member, positioning of the four-joint link array mechanisms can be implemented by the link guide member, and the mechanisms can be easily and accurately mounted.

As a preferable mode of the connecting link, the connecting link moves within the link guide space in the longitudinal direction of the connecting link, as described above. Therefore, the first abutment projection portion is provided at least on the undersurface side of the paper-cutting start side end portion of the connecting link. Thereby, the connecting link can be partly brought into contact with a portion of the inner circumferential surface of the link guide space, thereby enabling smooth sliding of the connecting link to be secured.

The paper holding member preferably has the second abutment projection portion that abuts on a part of the upper surface of the connecting link, on the end-portion undersurface of the connecting link on the side opposite the first abutment projection portion. The paper holding member preferably has the first abutment projection portion provided at least on a part of the undersurface of the paper-cutting start side end portion of the connecting link, and has the second abutment projection portion that abuts on the part of the upper surface of the connecting link, which is at the side opposite to the first abutment projection portion. In addition, the connecting links are preferably brought into partial contact between the paper holding member and the link guide member in such a manner as to be sandwiched in a vertical direction. The forming position of each of the abutment projection portions may be appropriately set corresponding to, for example, the lengths, widths, patterns, structures, and materials of the connecting links or the paper holding member. With the abutment projection portions thus formed, smooth sliding of the connecting links can be ensured.

For bridge-supporting of the paper holding member via the pair of the support members, the first resilient member is preferably interposed between the support member and the base. For the resilient member, a compression spring is preferably used. With urging force of the resilient member, the space between the paper holding plate of the paper holding member and the paper-placing face of the base can be secured with a necessary height, and a space for insertion of to-be-cut paper can be formed of that space.

The support member and the link guide member have guide openings for inductively guiding pivotal movements of the first and second pivotal links; and the link guide member has a guide plate for inductively guiding the movement of the connecting link in the longitudinal direction. The respective links of the four-joint link array mechanisms can be disposed across the support members and link guide member in the longitudinal direction. To accomplish this, the guide openings and/or guide plates are preferably formed in the support members and the link guide member.

The first and second pivotal links and connecting links can be inductively guided accurately and steadily along the guide openings and the guide plates. Thereby, entanglements, defective deflections, and the like of the respective links can be prevented, and smooth rotational operations thereof can be accomplished while leftward/rightward runout is being prevented, whereby quality of the four-joint link array mechanisms can be secured for a long time.

As a preferable mode of the paper holding plate and the link guide member, when to-be-cut paper placed on the base is press-held by the paper holding plate of the paper holding member, in a first stage, the to-be-cut paper can be press-held via the paper holding plate through deflection occurring in resistance with the elastic force of the first resilient member. In a second stage, the paper holding member is press-held via the paper holding plate through deflection occurring in resistance with the elastic force of the second resilient member. Accordingly, through combined operations of the first and second resilient members, the pressure force of the paper holding member to the base can be further increased. Further, regardless of the number of stacked to-be-cut paper sheets, to-be-cut paper can be press-held on the paper-placing face of the base intensively and securely, and an arbitrary number of to-be-cut paper sheets can be cut concurrently and in series into accurate sizes.

As another preferable mode of the paper holding plate and the link guide member, the paper holding plate and the link guide member may be formed into an integral unit. According to this construction, the paper holding plate and the link guide member need not to be formed into an intricate structure, and in association with reduction in components of the paper cutter, reduction of costs such as assembly costs, manufacturing costs, and material costs can be implemented. Further, miniaturization, compaction, and weight reduction of the overall paper cutter can be securely accomplished.

When cutting to-be-cut paper placed on the base, the cutting position of the to-be-cut paper is positioned in accordance with the edge of the paper holding member. Then, the moving unit such as the slider including a cutting blade is moved along the guide face of the paper holding member. Thereby, a side face of the cutting blade provided to the moving unit can guided in contact with the edge of the paper holding member, and the to-be-cut paper can be cut based on the edge of the paper holding member as a reference line. A fixed blade, rotary blade, or the like may be used as the cutting blade.

The paper holding member has the guide face for sliding and guiding the moving unit, so that the four-joint link array mechanisms do not interfere with one another, and safety, reliability, and the like in use can be significantly enhanced. In addition, as described above, even when the moving unit is moved to any position in association with the movement of the moving unit, to-be-cut paper can be substantially uniformly press-held by the paper holding member via the four-joint link array mechanisms along the longitudinal direction of the paper holding member. Consequently, even at a relatively low force, one or more to-be-cut paper sheets can be cut very easily and quickly.

DESCRIPTION OF THE PREFERRED EMBODIMENTS

Preferred embodiments of the present invention will be described below with reference to the accompanying drawings.

Figure 1:
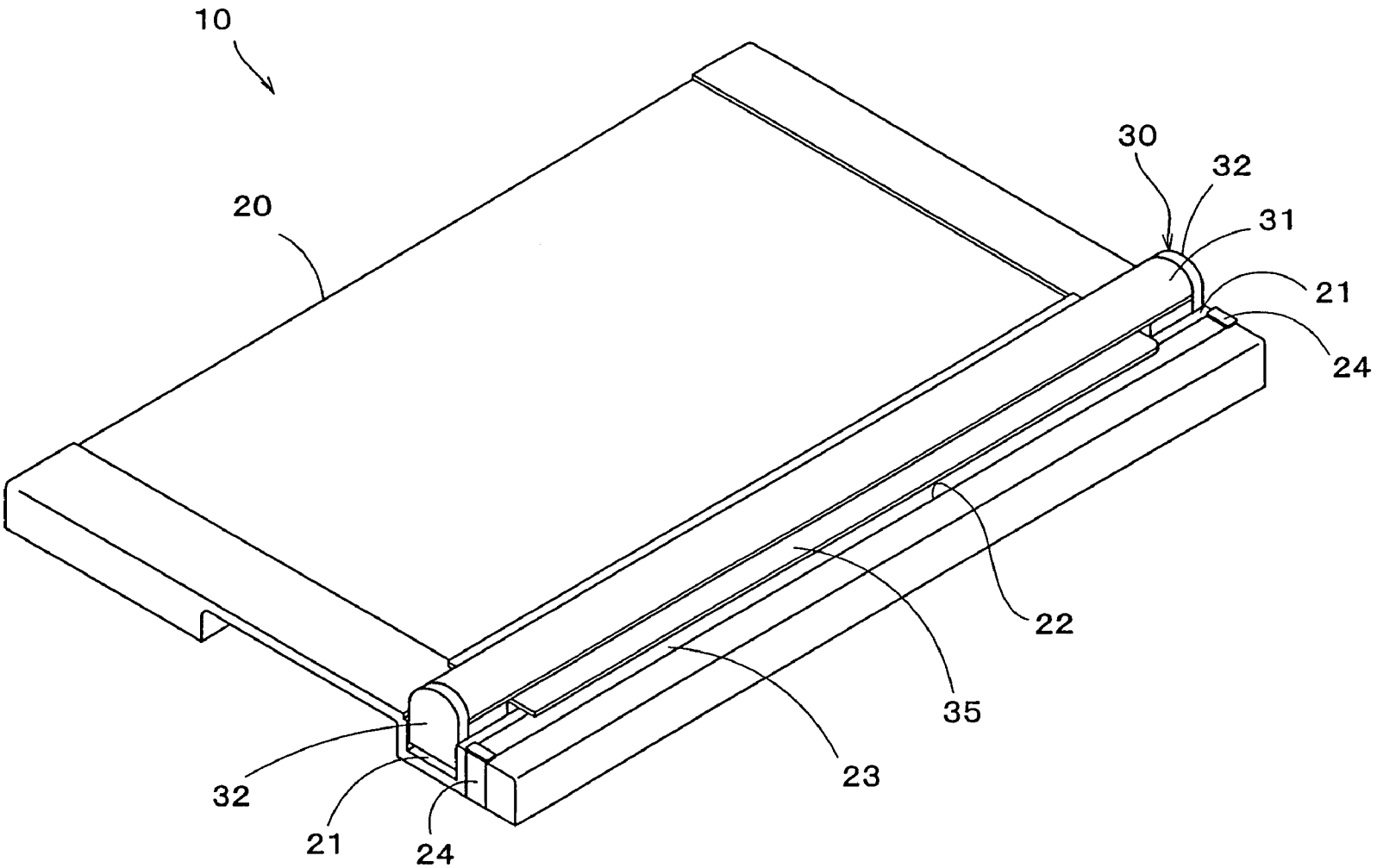
FIG. 1 is an overall perspective view schematically showing major portions of a paper cutter of a representative embodiment according to the present invention.
Figure 2:
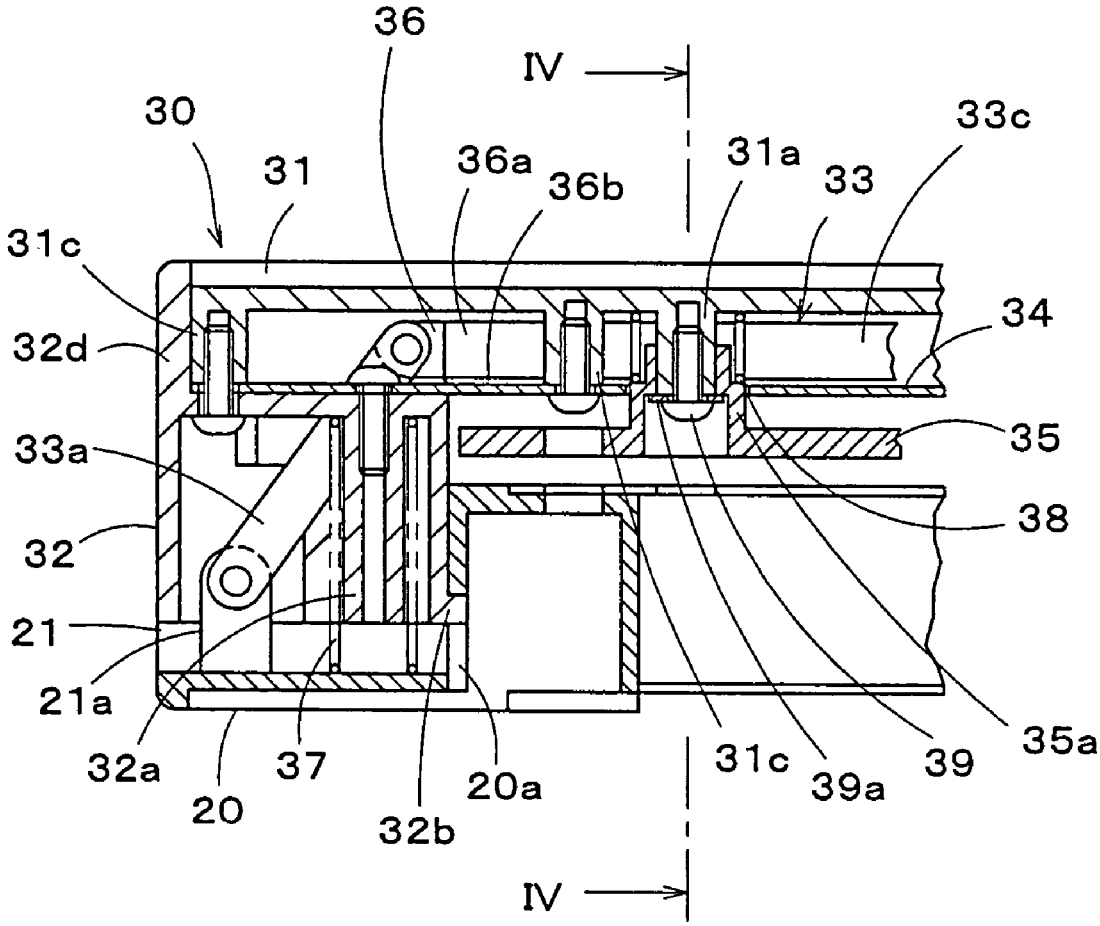
FIG. 2 is an enlarged major-portion sectional view longitudinally cutaway of major portions of a paper holder unit partly constituting the paper cutter.
Figure 3:
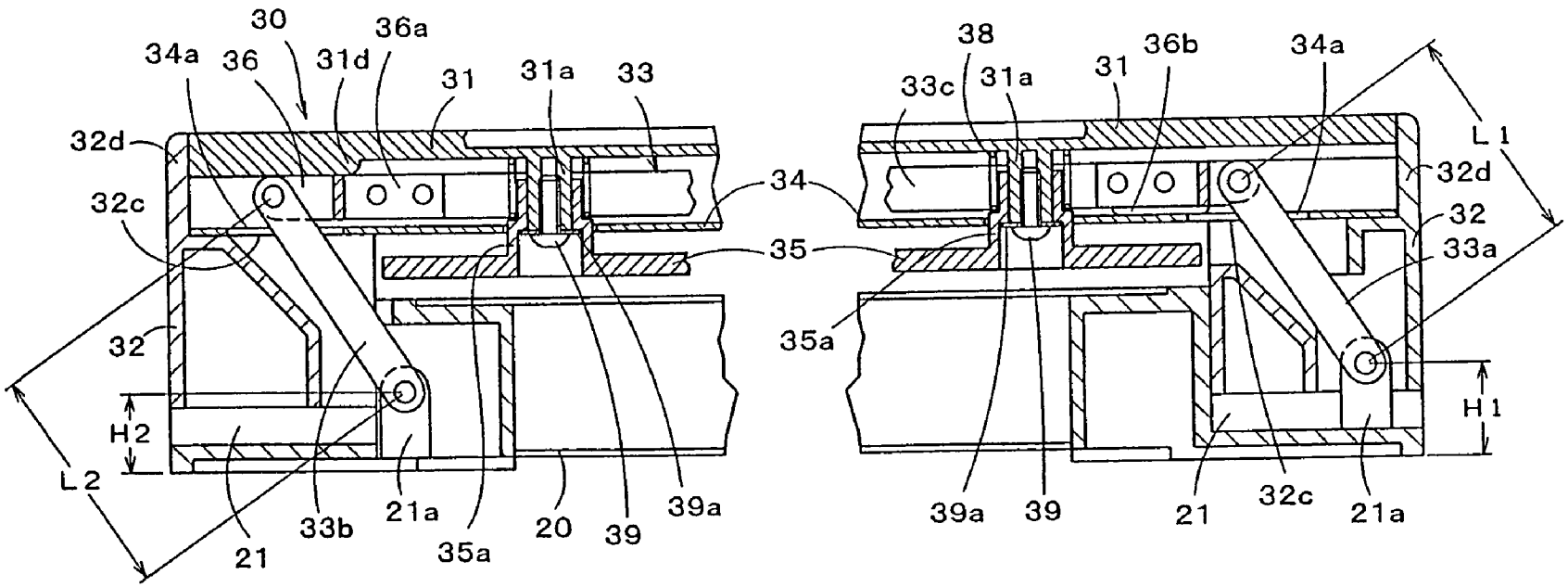
FIG. 3 is an enlarged major-portion sectional view longitudinally cutaway of major portions of the paper holder unit.
Figure 4:
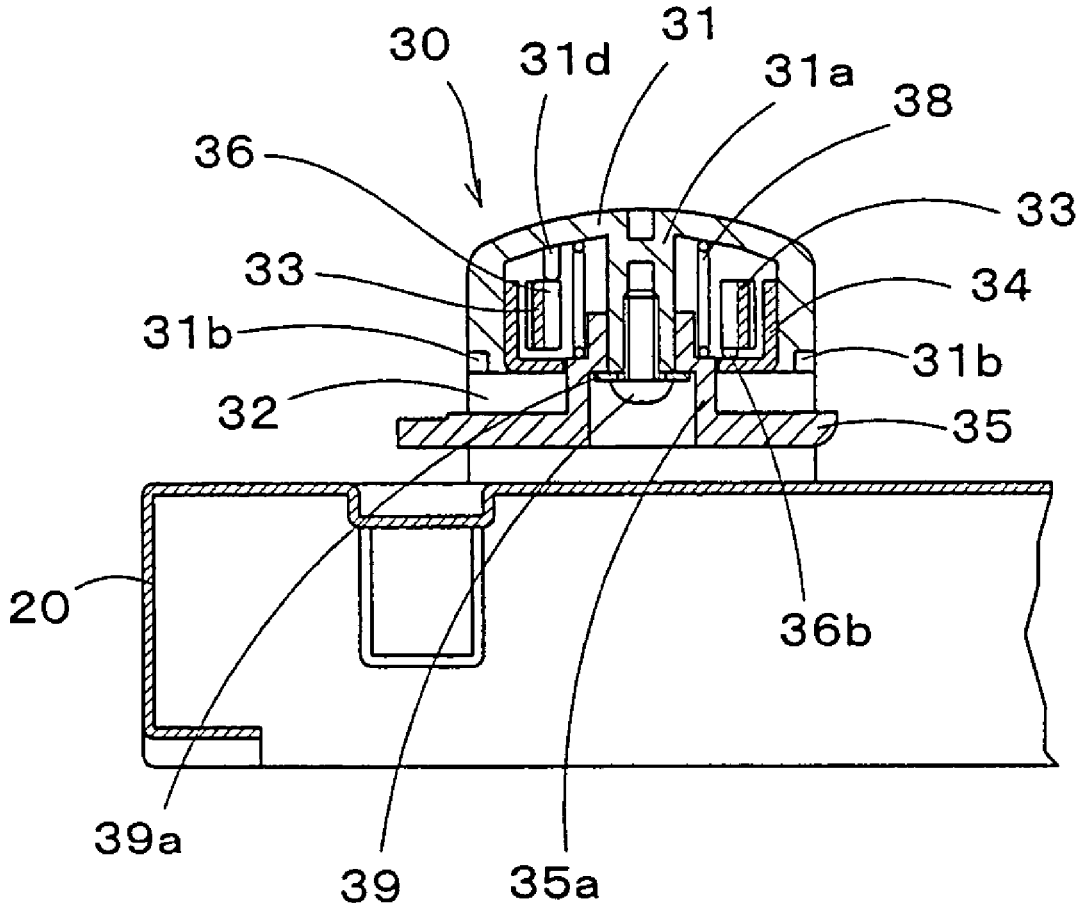
FIG. 4 is a cross-sectional view taken along the line IV—IV of FIG. 2.
Figure 5:
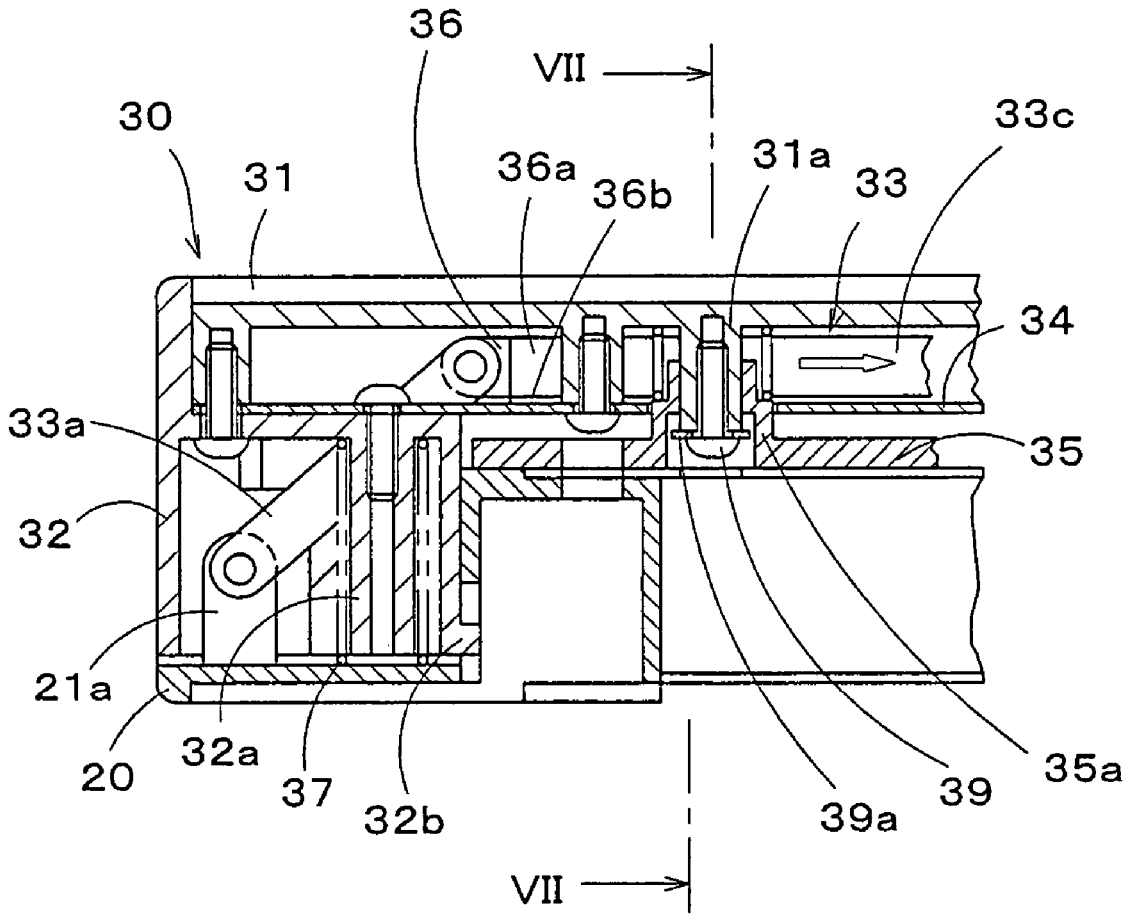
FIG. 5 is a major-portion sectional view showing an operation state of the paper holder unit.
Figure 6:
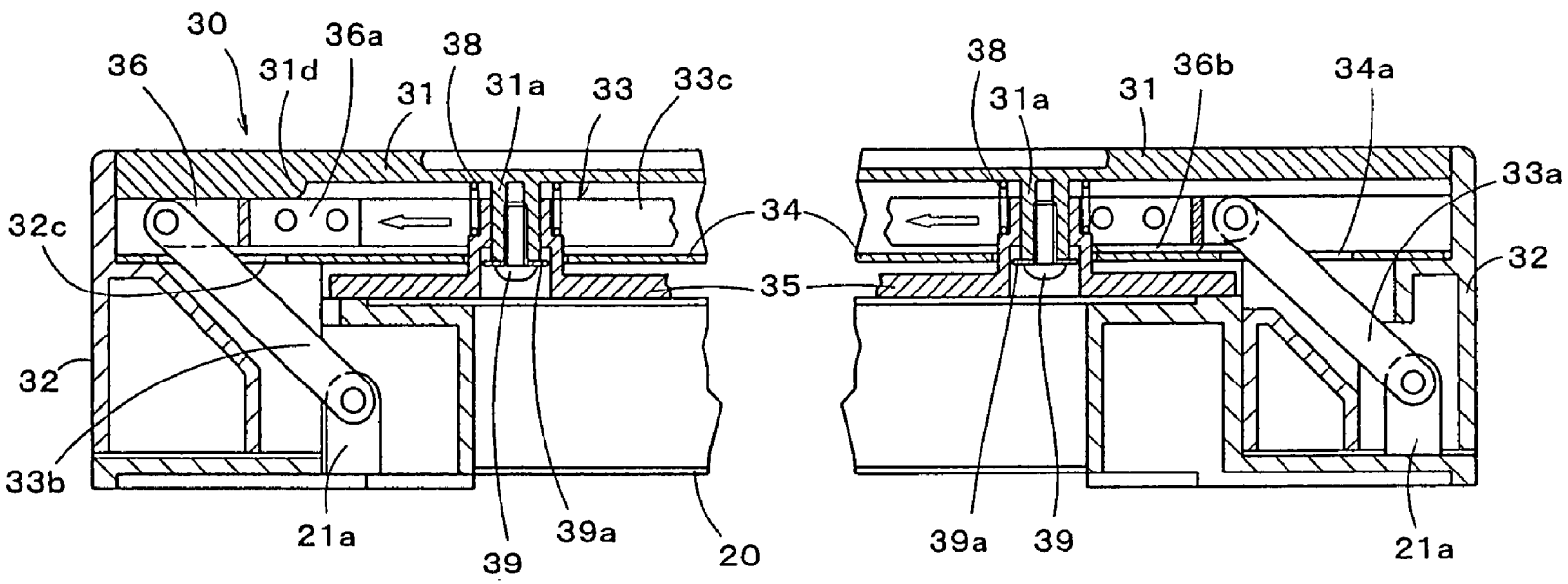
FIG. 6 is a major-portion sectional view showing an operation state of the paper holder unit.
Figure 7:
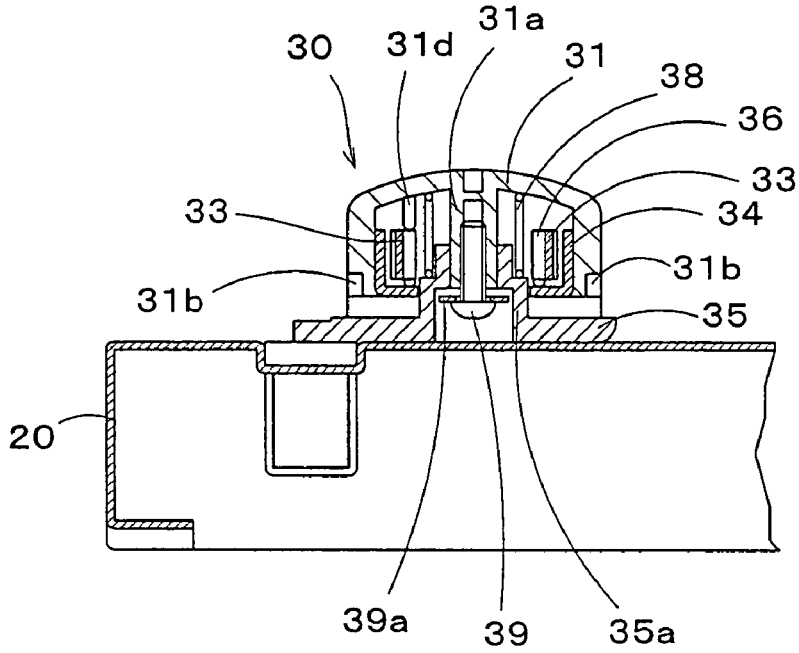
FIG. 7 is a cross-sectional view taken along the line VII—VII of FIG. 5.
Figure 8:
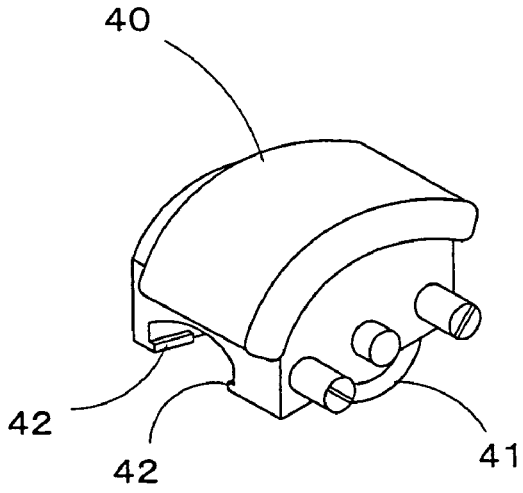
FIG. 8 is an enlarged overall perspective view schematically showing a slider partly constituting the paper cutter.

FIGS. 1 to 8 show a representative embodiment of the present invention. FIG. 1 is an overall perspective view schematically showing major portions of a paper cutter of the embodiment; FIGS. 2 and 3 are enlarged major-portion sectional views longitudinally cutaway of major portions of a paper holder unit partly constituting the paper cutter; FIG. 4 is a cross-sectional view taken along the line IV—IV of FIG. 2; FIGS. 5 and 6 are major-portion sectional views each showing an operation state of the paper holder unit; FIG. 7 is a cross-sectional view taken along the line VII—VII of FIG. 5; and FIG. 8 is an enlarged overall perspective view schematically showing a slider partly constituting the paper cutter. In describing the present embodiment, a paper cutting direction (longitudinal direction) will be expressed by using the words "front" and "rear," and the direction perpendicular to the paper cutting direction will be expressed by using the words "left" and "right."

A paper cutter 10 shown in FIG. 1 has a rectangular base 20 having a paper-placing face on which to-be-cut paper (not shown) is placed; a paper holder unit 30 that positions the to-be-cut paper on the paper-placing face of the base 20 and press-holds the paper; and a slider 40. The slider 40 moves along a straight-rod-like paper holding member (rail member) 31 partly constituting the paper holder unit 30 and, as shown in FIG. 8, rotatably supports a rotary cutting blade 41 provided as a cutting blade that cuts the to-be-cut paper into a desired size. The cutting blade will be described with reference to the example that uses the rotary cutting blade, however, the present invention is not limited by the rotary cutting blade. For example, a linear fixed blade or a fixed blade having a curved camber may be used.

Figure 9:
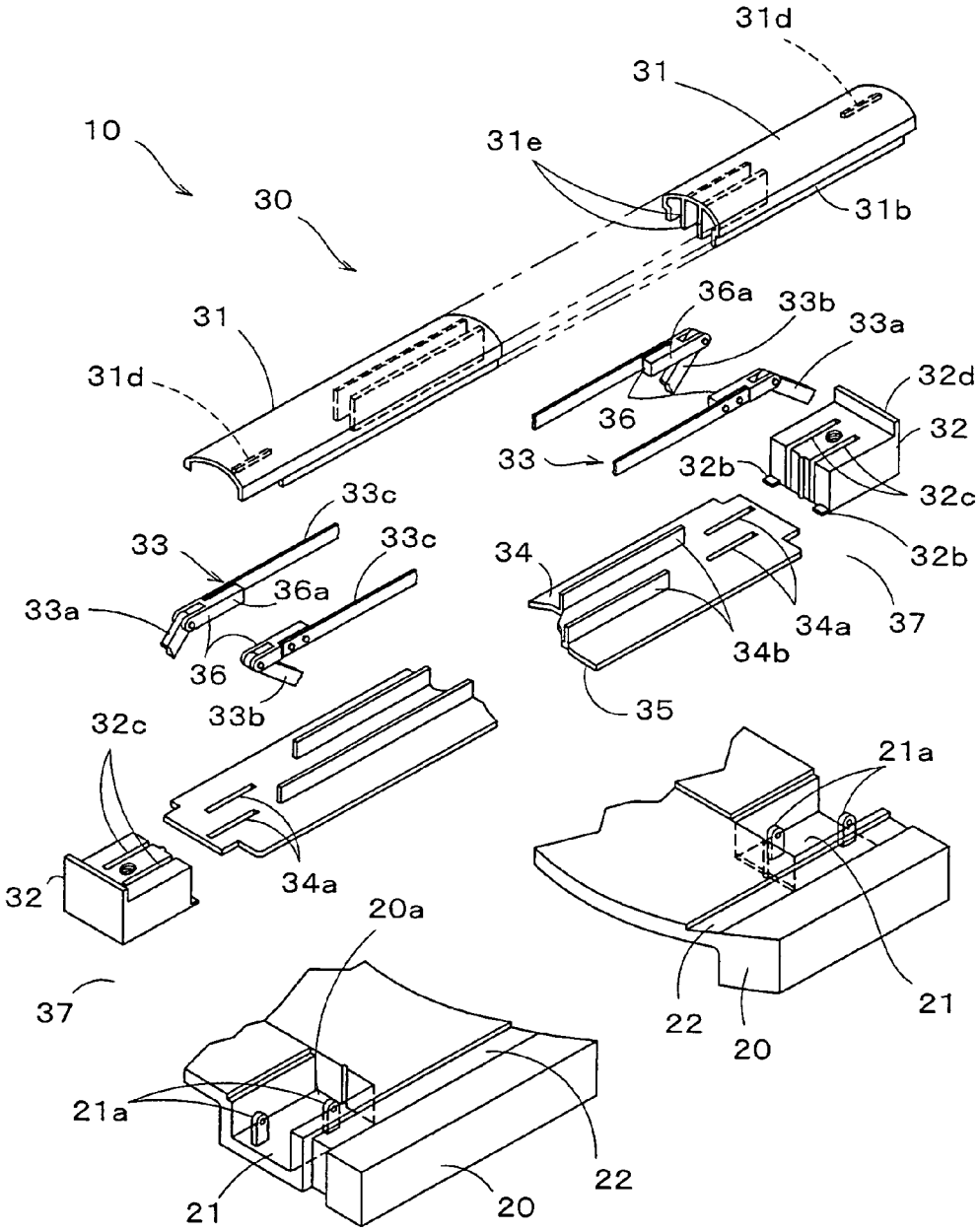
FIG. 9 is an exploded schematic perspective view partially cutaway of major portions of a modified example of the paper holder unit.

The base 20 is formed of a general-use metal material or plastic material. Recessed portions 21, 21 are formed in both side end portions of the base 20 in the longitudinal direction (paper cutting direction). Left and right sidewall portions of inner wall surfaces of the respective recessed portions 21 are formed to serve as guide faces for performing vertical slide-guiding of the paper holding member 31. Introduction guide paths for introduction of first and second support members 32, 32, which are components of the paper holder unit 30, are formed in a space between the guide faces of the recessed portions 21. These areas are constructed to enable easily introducing and guiding the support members 32 along the guide faces of the both left and right walls of the recessed portions 21. A pair of front and rear link-mounting flanges 21*a*, 21*a* are vertically arranged in the forms alternating with each other on both left and right sides of a bottom wall of the respective recessed portions 21, as shown in FIG. 9. On the lower surface of the base, pads (not shown) of a rubber material or the like having a high friction coefficient are fixedly integrated by appropriate fixing means, thereby enabling the paper cutter to be securely held in a predetermined position.

A narrow engagement concave portion 22 extending to both side edges of the base 20 in the longitudinal direction thereof is linearly extensionally disposed on the paper-placing face of the base 20 that is adjacent to the recessed portions 21. The engagement concave portion 22 engageably supports a narrow blade reception plate 23 (refer to FIG. 1) formed of a hard rubber material or the like, and the mounted portion of the engagement concave portion 22 corresponds to a cutting portion of the rotary cutting blade 41 of the slider 40, as shown in FIG. 8. In the both side end portions of the engagement concave portion 22 in the longitudinal direction, a pair of fixing members 24, 24 for supporting both side upper ends of the blade reception plate 23 in the longitudinal direction thereof is rotatably provided and the blade reception plate 23 is fitted to be replaceable.

As shown in FIGS. 2, 3, and 9, the paper holder unit 30 has, on the right and left sides of the paper holding member 31, a pair of first and second four-joint link array mechanisms 33, 33 that impart a substantially uniform pressing force in the longitudinal direction of the paper holding member 31 in cooperation with a vertical movement of the paper holding member 31. The four-joint link array mechanisms 33 are a primary feature of the present invention. The four-joint link array mechanisms 33 of the representative embodiment of the present invention are formed of link in which two points are supported vertically pivotable as static kinematic pair and other two points are supported as dynamic kinematic pair. The four-joint link array mechanisms 33 are capable of constantly maintaining the vertical movement of the paper holding member 31 to be parallel with respect to the base, and even when an arbitrary position in the paper holding member 31 is depressed, capable of pressing the paper holding member 31 by using a tension force acting in the link pivotal movement direction, thereby enabling steadily securing a substantially high uniform pressing force over the full length of the paper holding member 31 in the longitudinal direction.

As shown in FIGS. 2 to 4, the paper holder unit 30 further has the pair of front and rear support members 32, 32 vertically movable with respect to the base 20; the paper holding member 31 transversely disposed between the pair of support members 32, 32; a link guide member 34 disposed between the support members 32; and a paper holding plate 35 that is operably detachable and contactable with respect to the paper-placing face of the base 20 in cooperation with the vertical movement of the paper holding member 31. Thereby, another characteristic feature of the paper cutter 10 of the present invention is formed.

The components of the paper holder unit 30, namely, the paper holding member 31, support members 32, link guide member 34, and paper holding plate 35 are formed of, for example, thermoplastic resin such as for example, polyamide, polyacetal, polypropylene, and polybutylene terephthalate, and thermoplastic resin materials added with a wear-resistant reinforcement material and are manufactured by injection molding, respectively.

The four-joint link array mechanisms 33, which are the major components of the paper holder unit 30, are formed as described hereunder. As shown in FIGS. 2, 3, and 9, end portions of links of 33*a* to 33*c* are pin-connected, first and second pivotal links 33*a* and 33*b* are pivotably supported on the link-mounting flanges 21*a*, 21*a*, and the end portions pivotably supported on the link-mounting flanges 21*a*, 21*a* of the first and second pivotal links 33*a* and 33*b* are set as static kinematic pair.

Accordingly, the free end portions of the first and second pivotal links 33*a* and 33*b* are dynamic kinematic pair. The connecting link 33*c* for interconnecting the dynamic kinematic pair extends along a reverse side of a pressing face of the paper holding member 31, more specifically, between the paper holding member 31 and the link guide member 34. The first and second pivotal links 33*a* and 33*b* are formed of a thermoplastic resin material, and the connecting link 33*c* is formed of a long and narrow metal plate material having flexibility.

The illustrated example four-joint link array mechanisms 33 are constructed of two sets of the four-joint link array mechanisms 33 disposed in parallel between the support members 32. Two sets of four-joint link array mechanisms 33, 33 are each constructed of one pair of first and second four-joint link array mechanisms 33, 33. The two sets of four-joint link array mechanisms 33 on both left and right sides have similar structures. However, as shown in FIG. 9, adjacent first and second pivotal links 33*a* and 33*b* between the respective four-joint link array mechanisms 33 are disposed with their tilt directions set in opposition to intersect with each other.

In the present embodiment, the second pivotal link 33*b* of the second set of four-joint link array mechanisms 33 is disposed adjacent to the first pivotal link 33*a* of the first set of four-joint link array mechanisms 33. In addition, the first pivotal link 33*a* of the second set of four-joint link array mechanisms 33 is disposed adjacent to the second pivotal link 33*b* of the first set of four-joint link array mechanisms 33. The respective four-joint link array mechanisms 33 are constructed to oppositely move the respective connecting links 33*c* with respect to the longitudinal direction in association with the pivotal movements of the first and second pivotal links 33*a* and 33*b* disposed to intersect with each other. The first set and second set of four-joint link array mechanisms 33 have similar constructions, the links operating in the same direction are shown by using same characters, and individual descriptions of the respective links are omitted here.

As another primary characteristic feature of the four-joint link array mechanisms 33, a link length (L1) of the first pivotal link 33*a* on a final cutting position side is set slightly shorter than a link length (L2) of the second pivotal link 33*b* on a cutting start position side, as shown in FIG. 3. The static kinematic pair of the first pivotal link 33*a* is set to a position slightly higher than the static kinematic pair of the second pivotal link 33*b*.

Accordingly, a center height (H1) of a link pivotal movement hole of the link-mounting flanges 21*a* on the first pivotal link 33*a* side is slightly higher than a center height (H2) on the second pivotal link 33*b* side.

The connecting link 33*c* in one set of the respective sets of four-joint link array mechanisms 33 is preferably disposed so as to be slanted upward from one end portion of the paper holding member 31 on the cutting start position side to the other end portion thereof on the final cutting position side. Concurrently, the connecting link 33*c* in the other set is preferably disposed so as to be slanted downward in opposition thereto to intersect with the connecting link 33*c* in the one set.

The above-described relationship is summarized as: the link length (L1) of the first pivotal link 33*a*<the link length (L2) of the second pivotal link 33*b*; and the center height (H1) of the link pivotal movement hole of the link-mounting flanges 21*a* on the first pivotal link side>the center height (H2) of the link pivotal movement hole of the link-mounting flanges 21*a* on the second pivotal link side. When the four-joint link array mechanisms 33 are formed to satisfy the above-described relationship, the shorter first pivotal link 33*a* can be pivotally moved at a pivotal movement radius smaller than that of the longer second pivotal link 33*b*.

In the event that the first pivotal link 33*a* and the second pivotal link 33*b* are both depressed from the upper side by the paper holding member 31 depressed by the slider 40, while intensively depressing the shorter first pivotal link 33*a* via the connecting link 33*c*, the longer second pivotal link 33*b* rotationally moves downwards in accordance with a pivotal movement difference (rotational movement difference) between the first pivotal link 33*a* and the second pivotal link 33*b*.

In this event, the depression force intensively acts as a force of pulling the connecting link 33*c* in the longitudinal direction, thereby rotationally moves the connecting link 33*c* to the lower side. With the force occurring at this event, at least one of the first pivotal link 33*a* and the second pivotal link 33*b* is kept rotationally moved. Thereby, the paper holding member 31 is constantly kept depressed to the lower side, whatever may be the position for acting the depression force by the slider 40 on the paper holding member 31. In this manner, the pivotal movement of the first pivotal link 33*a* and the second pivotal link 33*b* enables the press-holding force of the paper holding member 31 to increase.

According to the present embodiment, the four-joint link array mechanisms 33 of the respective sets are both synchronously depressed, when the slider 40 is slid with depressing the paper holding member 31 in a direction from the second pivotal links 33*b* on the cutting start position side to the first pivotal links 33*a* on the final cutting position side. In the four-joint link array mechanisms 33 of each of the sets, the second pivotal link 33*b* on the one side plays the role of a base point, and the first pivotal link 33*a* receives the pulling force of the connecting link 33*c* and rotationally moves in the same direction as the second pivotal link 33*b*.

An a reverse operation with respect to the above operation occurs in the event that when the slide position of the slider 40 exceeds an intermediate position between the one end portion of the paper holding member 31 on the cutting start position side and the other end portion thereof on the final cutting position side. That is, the second pivotal link 33*b* of the other set plays the role of the base point, and the first pivotal link 33*a* of the same set receives the pulling force of the connecting link 33*c* and rotationally moves. Accordingly, regardless of the slide position of the slider 40, bias nonuniformity does not takes place in the pressure force of the paper holding member 31 that acts on to-be-cut paper over the full length of the paper holding member 31 in the longitudinal direction. Consequently, the pressing face of the paper holding member 31 can be steadily, intensively, and substantially uniformly pressure-held at all times with respect to to-be-cut paper (not shown).

As shown in FIGS. 2, 3, and 9, the connecting links 33*c* according to the illustrated example are pin-connected to the first and second pivotal links 33*a* and 33*b* at the free ends of the first and second pivotal links 33*a* and 33*b* through first and second link connection arms 36 formed of a thermoplastic resin material and held to be relatively rotationally movable.

As shown in FIG. 9, each of the link connection arms 36 is shaped overall as a two-legged tuning fork and formed from an insertion unit having a substantially U-shaped insertion opening. The each link connection arm 36 is pin-connected rotationally movably to the free end portion of the first or second pivotal link 33*a* or 33*b* in the state where the insertion opening is directed in the horizontal direction. However, the type of connection between the connecting link 33*c* and the first or second pivotal link 33*a* or 33*b* is not limited to the pin connection, and an appropriate construction can be employed as long as the construction enabling the connecting link 33*c* to be supported pivotable with the first or second pivotal link 33*a* or 33*b*.

In a proximal portion of the link connection arm 36, there is provided a flange 36*a* having a rectangular outer pattern projecting to the longitudinal direction of the connecting link 33*c*. The end portion of the connecting link 33*c* is fixed in such a manner that one end face of the flange 36*a* is screwed and lapped flat, and is then heater-heating welded, ultrasonically welded, or high-frequency welded.

As another primary characteristic feature in the four-joint link array mechanisms 33, on an undersurface of a cutting-finishing-side end portion of the connecting link 33*c*, a linear abutment rib 36*b* is provided in the form of a projection as a first abutment projection portion that presses the link guide member 34 from the upper surface thereof. As shown in FIGS. 2 and 3, the abutment rib 36*b* is disposed on an undersurface of the flange 36*a* of the link connection arm 36 for the first pivotal link 33*a* shorter than the second pivotal link 33*b*, and is set to the size such as to be gradually longer toward the movement direction of the connecting link 33*c*.

With the abutment rib 36*b* being provided to any one of the link guide member 34 and the link connection arm 36, the link guide member 34 and the link connection arm 36 are brought into partial contact with each other in a projection area of the abutment rib 36*b*. Thereby, smooth sliding of the connecting link 33*c* is secured.

As described above, according to the present invention, with the pulling force acting on the connecting link 33*c* during pivotal movement of the respective pivotal links 33*a* and 33*b*, a substantially uniform pressing force can be obtained over the longitudinal direction of the paper holding member 31. Consequently, influences of distortion of the connecting links 33*c* are not imposed, and the correlative positional relations between the paper holding member 31 and the four-joint link array mechanisms 33 need not be strictly set.

The present embodiment uses the long and narrow metal plate material having flexibility for the connecting links 33*c*. However, the present invention is not limited by the material, and the connecting link 33*c* may have any structure as long as it enables the dynamic kinematic pair of the first and second pivotal links 33*a* and 33*b* to be interconnected. For example, in stead of the flexible metal plate material, the structure may be formed by using any of various other inexpensive materials, such as flexible resin plate materials and wire rod type materials made of, for example, a rope and wire. Thus, since expensive materials having specific quality need not be used, the economical effect is enhanced, thereby obviating the necessity of specifically limiting the size, pattern, structure, material, and the like of the connecting link 33*c*.

The first and second support members 32, 32, which are supported in the first and second recessed portions 21 of the base 20 to be vertically movable, are each constructed of a rectangular frame unit comprising a flat upper surface portion, wall portions formed in front, rear, left and right portions and an opened undersurface. As shown in FIG. 2, a cylindrical boss 32*a* is formed to protrude downward in an inner-face central portion in an upper surface portion of the rectangular frame unit. A link accommodation space portion for accommodating part of the respective four-joint link array mechanisms 33 to be pivotally movable is formed in the rectangular frame unit.

A stopper portion 32*b* bent frontward at a substantially right angle is formed in a lower-end central portion of the front wall portion of the support members 32. In addition, as shown in FIG. 3, a first guide opening 32*c* for inductively guiding the pivotal movement of the first and second pivotal links 33*a* and 33*b* is vertically through-formed in the link accommodation space portion in an upper surface portion of the support member 32.

On an outer circumferential surface of the cylindrical boss 32*a*, a first compression spring 37 is interposed to extend between the surface and a bottom surface of the recessed portion 21. The support member 32 is constantly urged upward by an elastic force of the compression spring 37. A push-up force of the first compression spring 37 is received in a manner that the stopper portion 32*b* of the support members 32 engages with an upper-portion opening end of a transverse through-hole 20*a* of the base 20 that is formed to traverse lower peripheral portions of the link accommodation space portion in the longitudinal direction. The support members 32 are static at a height necessary for forming a gap for insertion of to-be-cut paper between the paper holding plate 35 and the paper-placing face of the base 20.

The paper holding member 31, which is transversely disposed between the support members 32, has a ceiling wall portion, which has substantially the same dimension as the longitudinal dimension of the base 20, and left and right sidewall portions. The paper holding member 31 has a sectional shape with the undersurface opened as a substantially transverse "C". The outer surface of the ceiling wall portion is defined as a guide surface for sliding and guiding the slider 40.

As shown in FIGS. 3 and 4, for convenience, two cylindrical mounting bosses 31*a*, 31*a* for mounting the paper holding plate are formed to protrude downward with a predetermined space in the longitudinal direction in an inner-surface central portion of the ceiling wall portion. An engagement stepped portion 31*b* for sliding and guiding the slider is formed with a step inwardly formed from a lower-edge-portion outer surface of the left or right sidewall portion. Sidewall plates 32*d*, 32*d* respectively constituting front and rear sidewall portions in the paper holding member 31 stand with a predetermined space between mutually opposite faces thereof on upper surfaces of the respective support members 32. Both-side opening ends in the longitudinal direction of the paper holding member 31 are provided to be closed between the opposite faces.

As shown in FIG. 2, screw insertion openings that are vertically through-formed in the support members 32 are formed in an inner-surface central portion of the ceiling wall portion of the paper holding member 31. In the paper holding member 31, a required number of cylindrical mounting bosses 31*c* . . . , 31*c* are formed downwardly in the positions respectively corresponding to the screw insertion openings vertically through-formed. Screws are tightened via the respective screw insertion openings into inner screws formed in the cylinder portions of the cylindrical mounting bosses 31*c*, thereby enabling tighten-fixing. Thereby, the paper holding member 31, support members 32, and link guide member 34 can be fixedly supported to be integrated.

As another characteristic feature of the paper holding member 31, as shown in FIG. 3, a linear abutment rib 31*d* that is a second abutment projection portion is provided to project downward in a position corresponding to the longer second pivotal link 33*b* in an inner-surface central portion of the ceiling wall portion. An abutment surface of the abutment rib 31*d* is formed as a portion that presses the second pivotal link 33*b* from the upper surface thereof.

On a lower end face of the flange 36*a* of the link connection arm 36 disposed on the side of the first pivotal link 33*a* shorter than the second pivotal link 33*b*, the first abutment rib 36*b* is provided to project vertically alternately therewith in the same direction. Further, the second abutment rib 31*d* is set longer than the first abutment rib 36*b*, and is set larger than the projection dimension of the first abutment rib 36*b*.

With the first and second abutment ribs 36*b* and 31*d*, the second abutment rib 31*d* on the second pivotal link side presses the first and second pivotal links 33*a* and 33*b* at a pressure force relatively higher corresponding to the projection height of the first abutment rib 36*b* on the first pivotal link side. The forming position of the each abutment rib 36*b*, 31*d* may be appropriately set corresponding to, for example, the lengths, widths, patterns, structures, and materials of the paper holding member 31, the link guide member 34, and the link connection arm 36. For any of them, smooth sliding of the connecting link 33*c* is ensured since the first and second abutment ribs 36*b* and 31*d* are formed. In stead of the linear abutment rib, a rib may be formed into a structure and pattern as a simple projection portion, for example.

The link guide member 34 internally fixed to the inner surface of the lower-end edge portion of the paper holding member 31 is formed of a flat, long and narrow plate having substantially the same dimension as the longitudinal dimension of the paper holding member 31 and having a substantially U-shaped side face shape. As a characteristic feature of the link guide member 34, as shown in FIG. 3, the link guide member 34 has a second linear guide opening 34*a* in a position corresponding to the first guide opening 32*c* of the support members 32. With the second linear guide opening 34*a* thus provided, at the event of link pivotal movement, the respective pivotal links 33*a* and 33*b* and connecting link 33*c* can be inductively guided to a descending-limit position of the paper holding plate 35.

When the paper holding member 31 and the link guide member 34 are in a bridge-support state, a necessary space is maintained between the link guide member 34 and the paper holding member 31. A space surrounded by the upper surface of the link guide member 34, the inner surface of the paper holding member 31, and the opposite faces of the sidewall plates 32*d* of the pair of front and rear support members 32 is formed into a shape extending across the link accommodation space portion in the longitudinal direction. This space is used as a link guide space for inductively guiding the pivotal movement of each of the links 33*a* to 33*c*.

Thus, the space between the paper holding member 31 and the link guide member 34 is effectively used. Thereby, the pivotal movement positions of the respective pivotal links 33*a* and 33*b* and connecting link 33*c* can be steadily and securely obtained. In addition, the simple structure for guiding the pivotal links 33*a* and 33*b* and connecting links 33*c* linearly and inductively can be obtained. Further, with the link guide member 34, the four-joint link array mechanisms 33 are not exposed to the outside, so that mounting can be easily and accurately performed, and the paper cutter having high appearance quality and commercial value can be obtained.

As shown in FIGS. 2 to 4, the paper holding plate 35 is formed into a flat rectangular parallelepiped having substantially the same dimension as the dimension between the support members 32, and is externally fixedly mounted to be vertically movable with respect to an outer circumferential surface of the cylindrical mounting bosses 31*a* in the paper holding member 31 via insertion openings of the link guide member 34.

In a position corresponding to the cylindrical mounting boss 31*a* of the paper holding plate 35, an insertion portion 35*a* is protrusively in the upward direction at a height at which the insertion portion 35*a* having a cylindrical structure can be fixed to the cylindrical mounting boss 31*a*. The insertion portion 35*a* is constructed of a large-diameter circularly cylindrical portion having a circular-ring-shaped support face for positioning and supporting a second compression spring 38 in a portion between itself and the paper holding member 31, and a small-diameter circularly cylindrical portion that is externally fixed to be vertically movable with respect to the cylindrical mounting boss 31*a* of the paper holding member 31.

A fitting screw 39 is tightened and fixed to an inside screw formed inside a cylindrical portion of the cylindrical mounting boss 31*a* through a cylinder portion of the insertion portion 35*a* of the paper holding plate 35. Thereby, the paper holding plate 35 can be disposed at a necessary height that allows forming a space for insertion of to-be-cut paper between the paper holding plate 35 and the paper-placing face of the base 20.

The paper holding plate 35 is constantly urged downward through an elastic force of the second compression spring 38. The depression force of the second compression spring 38 can be received in a manner that a washer 39*a* functioning as a stopper fixed to the fitting screw 39 is engaged with an inner bottom face of the large-diameter cylinder portion of the insertion portion 35*a*.

In the present embodiment, the first compression spring 37 is provided between the support member 32 and the bottom face in the recessed portion 21 of the base 20, and the second compression spring 38 is provided between the paper holding member 31 and the paper holding plate 35. Consequently, in a first stage in which the to-be-cut paper placed on the base is press-held by the paper holding plate 35 of the paper holding member 31, the to-be-cut paper can be press-held via the paper holding plate 35 by deflection occurring in resistance with the elastic force of the first compression spring 37. As shown in FIGS. 5 to 7, in a second stage, the paper holding member 31 is further depressed. Thereby, the deflection occurring in resistance with the elastic force of the second compression spring 38 acts on the paper holding plate 35 whereby to perform a second-stage press holding for the to-be-cut paper.

In this manner, combined operations of the first and second compression springs 37 and 38 enable the pressure force between the base 20 and the paper holding member 31 to be further increased. Consequently, regardless of the number of to-be-cut paper sheets placed on the paper-placing face of the base 20, to-be-cut paper can be intensively press-held on the paper-placing face of the base 20, and an arbitrary number of to-be-cut paper sheets can be cut concurrently and in series into accurate sizes.

The slider 40 shown in FIG. 8 is shaped overall as a substantially transverse "C," and is externally fixed so as to be slidable along the engagement stepped portion 31*b* of the paper holding member 31. When cutting to-be-cut paper placed on the base 20, the cutting position of the to-be-cut paper is positioned in accordance with the edge of the paper holding member 31. Then, the slider 40 is moved along the engagement stepped portion 31*b* of the paper holding member 31, whereby the to-be-cut paper can be cut while a side face of the rotary cutting blade 41 of the slider 40 rotates in contact with the edge of the paper holding member 31.

An inner circumferential surface of the slider 40 has an circularly arc surface having the same curvature as the outer shape of the paper holding member 31 and is formed to be used as an engagement concave portion that is externally fixed to be across the outer circumferential surface of the paper holding member 31. In front and rear of an inner-circumferential-surface lower end of the slider 40, a pair of both-left-and-right engagement portions 42, 42 that are engageably supported to be slidable at a predetermined space along the direction of traversing the engagement stepped portion 31*b* of the paper holding member 31, respectively. For example, a slider disclosed in Japanese Utility Model Application No. 63-26776 submitted by the present applicant or a slider having a similar construction in a major-portion construction may be adapted to the slider 40 of the paper cutter of the present invention.

The paper holding member 31 has the engagement stepped portion 31*b* partly constituting the guide face for slidably guiding the slider 40, so that the operation is not interfered by the four-joint link array mechanisms 33, thereby significantly enhancing safety and reliability, for example, in the use thereof. In addition, in association with the movement of the slider 40, to-be-cut paper can be intensively press-held via the four-joint link array mechanisms 33 in a substantially uniform manner in the longitudinal direction of the paper holding member 31, as described above. Consequently, one or more to-be-cut paper sheets can be cut very easily and quickly at a relatively low force.

The paper holder unit 30 constructed as described above is assembled by a regular method. In the paper holder unit 30, when an arbitrary position of the paper holding member 31 is depressed in association with sliding of the slider 40, the first and second four-joint link array mechanisms 33, 33 are both depressed from the upper side by the paper holding member 31 via the second abutment rib 31*d* of the paper holding member 31 and first abutment rib 36*b* of the first link connection arm 36. When the four-joint link array mechanisms 33 of the individual sets are both depressed, the first and second pivotal links 33*a* and 33*b* and connecting links 33*c* in the four-joint link array mechanisms 33 of the individual sets move in opposition to each other in the longitudinal direction.

With the movements of the respective links of 33*a* to 33*c*, the link guide member 34 and the paper holding plate 35 are both depressed toward the paper-placing face of the base 20. At this event, the four-joint link array mechanisms 33 of the individual sets move in the directions opposite to each other, and concurrently depress both the link guide member 34 and the paper holding plate 35. Consequently, the pair of both-left-and-right support members 32, 32, which bridge-support both the link guide member 34 and the paper holding plate 35 descend simultaneously in the same direction and at the same movement stroke.

Accordingly, although an arbitrary position of the paper holding member 31 is depressed by the slider 40 in association with sliding of the slider 40, the paper holding plate 35 moves downward while constantly maintaining the parallel state with respect to the base 20. This consequently enables the to-be-cut paper on the base 20 to be press-held.

The depression force of the paper holding member 31 at this event, with the pivotal movement difference (rotational movement difference) between the shorter first pivotal link 33*a* and the longer second pivotal link 33*b*, as described above, allows a pulling force to act on the connecting link 33*c* in association with the downward pivotal movement of the longer second pivotal link 33*b*, and concurrently, the shorter first pivotal link 33*a* to perform the downward pivotal movement.

Therefore, as long as the pulling force is present, the paper holding member 31 is depressed straight via the individual links of 33*a* to 33*c*. Consequently, the depression force of the paper holding member 31 in association with sliding of the slider 40 can be caused to directly act in a smooth and steady manner on the entirety of the paper holding member 31. In addition, a substantially uniform pressing force in the longitudinal direction of the paper holding member 31 can be generated between the paper holding member 31 and the base 20.

Accordingly, even when an arbitrary position of the paper holding member 31 is depressed in association with sliding of the slider 40, the paper holding plate 35 is steadily and intensively press-held at all times with respect to the paper-placing face of the base 20 without generating the deflection of pressure force.

When the pressure force of the slider 40 is relieved upon completion of paper-cutting, the support members 32 are pushed up by righting forces of the first and second compression springs 37 and 38 toward an initial standby position. With the push-up forces of the first and second compression springs 37 and 38, the paper holding member 31 in its entirety is moved upward so as to be able to return to the initial position.

Figure 10:
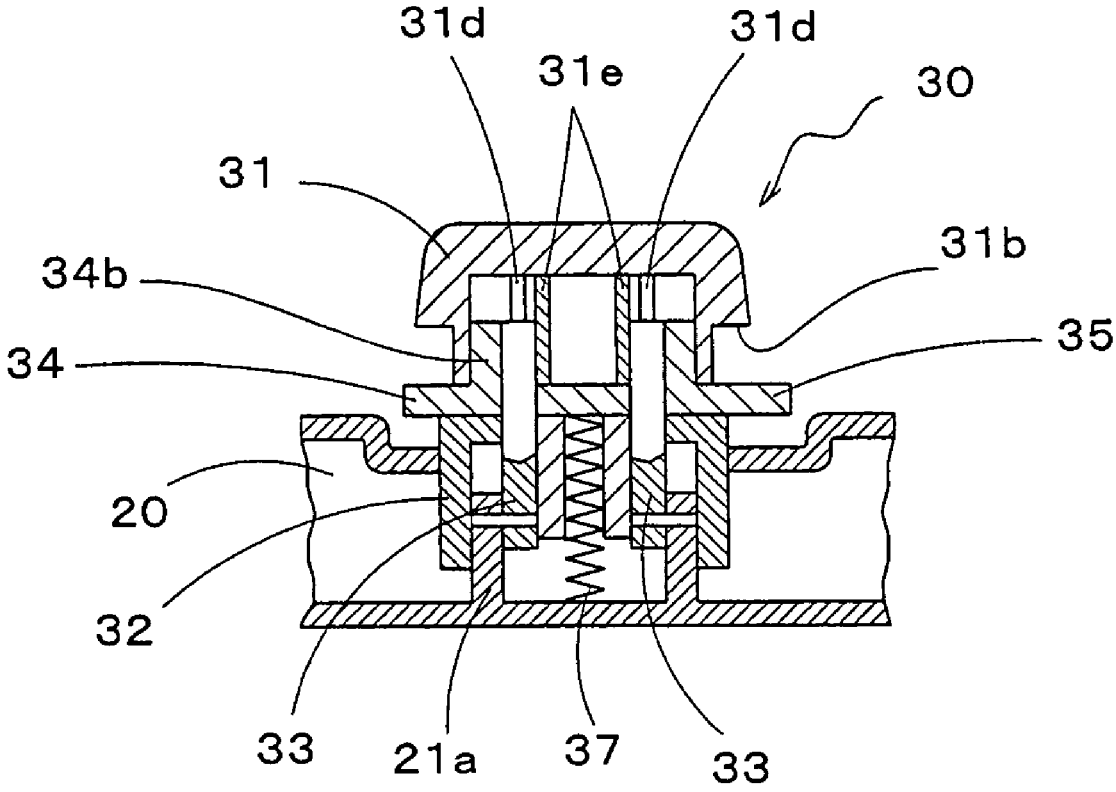
FIG. 10 is an enlarged major-portion sectional view of major portions of the paper holder unit.

FIGS. 9 and 10 show a modified example of a paper holder unit that is adapted to the paper cutter of the present invention. FIG. 9 is an exploded schematic perspective view partially cutaway of major portions of a modified example of the paper holder unit; and FIG. 10 is an enlarged major-portion sectional view of major portions of the paper holder unit. In these drawings, substantially the same members as those in the above-described embodiments are shown with the same reference characters, and detailed descriptions of the members are omitted herefrom.

With reference to these drawings, characteristic features of the paper holder unit 30 are that both the link guide member 34 and the paper holding plate 35 are formed into an integral unit and that guide plates 31*e* and 34*b* for inductively guiding the pivotal movement the four-joint link array mechanisms 33 are provided in portions of the paper holding member 31 and the link guide member 34. In the modified example, the paper holding plate 35 extending on the same plane from a long-side end face of the link guide member 34 constitutes the abutment surface for press-holding to the paper-placing face of the base 20.

As shown in FIGS. 9 and 10, the paper holding member 31 according to the illustrated example is formed of a long rectangular cover unit. The cover unit has a ceiling wall portion having a circularly arcuate sectional shape having a slow convex curved face in the upward direction, front and rear sidewall portions, and left and right sidewall portions, in which the dimension is substantially the same as the longitudinal dimension of the base 20, and the undersurface is opened.

On the inner surface of the ceiling wall portion, a pair of first guide plates 31*e*, 31*e* are protruded downwards in parallel and at a predetermined interval along positions inwardly off from two guide openings 34*a*, 34*a* of the link guide member 34. The first guide plates 31*e* constitute inductive guide faces for the respective connecting links 33*c* of the pair of both-left-and-right four-joint link array mechanisms 33, 33.

In the meantime, on the link guide member 34, a pair of second guide plates 34*b*, 34*b* constituting inductive guide faces for the connecting links 33*c* stands such that plate surfaces are parallel to opposite faces of the first guide plates 31*e* and along positions outwardly off from the two guide openings 34*a*, 34*a* of the link guide member 34.

Accordingly, the two guide openings 34*a*, 34*a* of the link guide member 34 are linearly formed along portions between opposite faces of the first guide plates 31*e* and the second guide plates 34*b*, whereby guide passages for inductively guiding the connecting links 33*c* are formed. The patterns, mounting positions, mounting quantity, and the like of the guide openings 34*a* and the respective guide plates 31*e* and 34*b* are not limited by the illustrated example.

In this manner, the first and second pivotal links 33*a* and 33*b* and connecting links 33*c* of the four-joint link array mechanisms 33 can be inductively guided accurately and steadily along the guide openings 34*a* and the respective guide plates 31*e* and 34*b* with overstrideing the support members 32 and the link guide member 34 in the longitudinal direction.

Consequently, entanglements, defective deflections, and the like of the respective links 33*a* to 33*c* can be prevented, and smooth rotational operations thereof can be accomplished while leftward/rightward runout is being prevented, whereby quality of the four-joint link array mechanisms 33 can be secured for a long time. Further, since the paper holding plate 35 and the link guide member 34 are formed into the integral unit, the paper holding plate 35 and the link guide member 34 can be integrated, thereby enabling implementing miniaturization, compaction, and weight reduction of the overall paper cutter 10. Further, reduction of components of the paper cutter 10 and reduction of costs such as assembly costs, manufacturing costs, and material costs can be implemented.

As above, description has been made with reference to the preferred embodiment and the modified example thereof. The objects of the present invention could of course be sufficiently achieved with one of the four-joint link array mechanisms 33 or an arbitrary combination thereof. Accordingly, it is a matter of course that the present invention is not limited by the above-described embodiment and modified example, and various design modifications may be done within the scope of the invention.

What is claimed is:

1. A paper cutter, wherein to-be-cut paper placed on a base is press-held by a straight-rod-like paper holding member, which is supported on the base and is vertically movable; and the to-be-cut paper is cut with moving a cutting blade along the paper holding member;

four-joint link array mechanisms are provided, each of the four-joint link array mechanisms comprising a first pivotal link swingably supported on a side of a final cutting position of the base, a second pivotal link swingably supported on a side of a cutting starting position of the base, and a connecting link rotatably supported between a free end of the first pivotal link and a free end of the second pivotal link and attached to the paper holding member along a face on a side opposite to a pressing face of the paper holding member; and the paper holding member is moved in a same direction with a moving direction of the cutting blade;

the four-joint link array mechanisms include first and second four-joint link array mechanisms disposed in parallel along the paper holding member;

the first and second pivotal links adjacent between the respective four-joint link array mechanisms are disposed to intersect with each other and to be slanted in directions opposite each other; and in association with pivotal movements of the first and second pivotal links disposed to intersect with each other, the respective four-joint link array mechanisms move the respective connecting links in opposition to each other in a longitudinal direction.

2. The paper cutter according to claim 1, wherein the first pivotal link is set slightly shorter than the second pivotal link.

3. The paper cutter according to claim 1, wherein the connecting link is formed of a plate material or a wire rod type material.

4. The paper cutter according to claim 1, further comprising:

a paper holding plate disposed with a necessary space with respect to the base; and a link guide space for guiding a longitudinal movement of the connecting link, which is provided between the paper holding member and the paper holding plate.

* * * * *